United States Patent [19]

Hulford et al.

[11] 4,445,940

[45] May 1, 1984

[54] PROCESS TO REMOVE CORROSION DEPOSITS USING AQUEOUS-BASE FERROMAGNETIC FLUIDS

[75] Inventors: Karen F. Hulford; Jerry W. Price, both of Bellingham, Wash.

[73] Assignee: Georgia-Pacific Corporation, Atlanta, Ga.

[21] Appl. No.: 445,559

[22] Filed: Nov. 30, 1982

[51] Int. Cl.[3] ..... C23G 1/00

[52] U.S. Cl. ..... 134/2; 134/3; 134/41; 134/42; 252/DIG. 14; 252/89.1; 252/173; 252/174.25; 252/530; 252/557; 252/558

[58] Field of Search ..... 134/1, 2, 3, 41, 42; 422/12; 210/698, 696; 252/DIG. 14, 62.51, 89.1, 173, 174.25, 530, 558, 557

[56] References Cited

U.S. PATENT DOCUMENTS

| | | | |
|---|---|---|---|
| 3,483,969 | 12/1969 | Rosensweig | 209/1 |
| 3,488,531 | 1/1970 | Rosensweig | 310/10 |
| 3,531,413 | 9/1970 | Rosensweig | 252/62.62 |
| 3,612,630 | 10/1971 | Rosensweig | 308/10 |
| 3,620,584 | 11/1971 | Rosensweig | 308/187.1 |
| 3,648,269 | 3/1972 | Rosensweig | 340/373 |
| 3,917,538 | 11/1975 | Rosensweig | 252/62.51 |
| 3,946,103 | 3/1976 | Hund | 423/633 |
| 4,018,691 | 4/1977 | Neal | 252/62.54 |
| 4,019,994 | 4/1977 | Kelley | 252/62.52 |
| 4,019,995 | 4/1977 | Briggs | 252/62.53 |
| 4,093,778 | 6/1978 | Reven | 428/411 |

OTHER PUBLICATIONS

CA 90333c, 77, 1969—Rust Removal from Metals Using Lignosulfonic Acid Compositions.

CA 85:64865y, 85, 1976—Preparation of the Rust Converter PRL-2 from Hydrolytic Lignin, (Russian).

CA 88:8735f, 88, 1978—Modification of Lignin by Phosphorylation and Amination, (Russian).

CA 83:62155b, 83, 1975—Preparation of the Rust Remover PRL-2 from Hydrolysis Lignin, (Russian).

CA 90:170390c, 90, 1979—Ammonolysis of Hydrolytic Lignin for Preparing a Rust Inhibitor, (Russian).

*Primary Examiner*—S. Leon Bashore, Jr.
*Assistant Examiner*—K. M. Hastings
*Attorney, Agent, or Firm*—Banner, Birch, McKie & Beckett

[57] ABSTRACT

A process for the removal of corrosion deposits from metal surfaces using a ferromagnetic fluid is disclosed.

14 Claims, No Drawings

PROCESS TO REMOVE CORROSION DEPOSITS USING AQUEOUS-BASE FERROMAGNETIC FLUIDS

This invention pertains to the removal of corrosion deposits from a variety of ferrous and non-ferrous metal surfaces employing ferromagnetic fluids.

Various materials are commonly used to remove corrosion deposits from metal surfaces. Among these materials are strong acid solutions (sulfuric, nitric, hydrochloric or phosphoric acids), proprietary formulations of strong caustic solutions of ethylenediaminetetraacetic acid, disodium salt (EDTA) or sodium gluconate, and solutions of chemicals such as ammonium citrate or sodium cyanide. These methods generally function by dissolution of the oxides and/or base metal.

However, a number of disadvantages exist with many of the presently used corrosion deposit removal materials. Some are highly toxic and/or pose chemical safety hazards. Some of the known materials require elevated temperatures for efficient oxide removal. An increase in the emission of corrosive and/or toxic fumes generally accompanies these higher temperatures. Because most of these corrosion deposit removal agents function by chemical dissolution of the oxides and/or base metal under highly corrosive conditions, there is always the possibility of dissolving more metal than desired.

Therefore, it is an object of this invention to provide a process for the removal of corrosion deposits from metal surfaces. A further object is to provide a process for the removal of corrosion deposits which can be used under conditions of minimum base-metal corrosion. Another object is to provide a corrosion deposit removal process which does not pose a chemical safety hazard and which is non-toxic. A further object is to provide a corrosion deposit removal process which does not require extremes of temperature or pH. A still further object is to provide a process of corrosion deposit removal which uses a material that has a high capacity per unit weight as a corrosion deposit removal agent.

The above and other objects may be attained by the process of this invention. According to this invention, there is provided a process for the removal of corrosion deposits from corroded metal surfaces which comprises contacting said corroded metal surfaces with an aqueous-base ferromagnetic fluid and thereafter removing said aqueous-base ferromagnetic material and corrosion deposits from said metal surface.

A ferromagnetic fluid is a material that contains iron in the form of an iron oxide, such as gamma ferric oxide or magnetite, along with an organic suspending agent. When suspended in water, these materials become ferromagnetic fluids.

Ferromagnetic fluids are produced by suspending finely divided metal oxides in a suitable solvent. The finely divided metal oxide may be produced either by a chemical process or a grinding process in which iron oxide is admixed with a dispersant and the mixture is ground as described inter alia, in U.S. Pat. No. 3,917,538. Examples of suitable ferromagnetic fluids are the material described in U.S. Pat. No. 4,019,994, which is produced by suspending ferromagnetic particles in an aqueous medium; the material described in U.S. Pat. No. 4,018,691, obtained by reaction of soluble iron salts with a sulfonated phenol-formaldehyde polymer; a 200 gauss water-based ferromagnetic fluid marketed by Ferrofluidics Corporation, Catalog No. A05; and the material described in U.S. Pat. No. 4,019,995. To obtain the latter ferromagnetic fluid, a water-soluble iron salt is dissolved in an aqueous medium of sulfonated lignin or sulfonated tannin and further treated according to the patent. Other metals, such as nickel or manganese, may be included in the preparation along with the iron salt.

The lignosulfonate ferromagnetic fluid of U.S. Pat. No. 4,019,995 is a black or brown viscous aqueous liquid with no appreciable odor and constitutes one preferred embodiment of this invention. It is non-flammable and contains no hazardous ingredients. However, it is not compatable with strong acids and oxidizing agents. An extremely low order of toxicity is exhibited following acute peroral intubation. By Federal Hazardous Substances Act definition, this ferromagnetic fluid is not an irritant to the skin or eyes and is not toxic.

Corrosion deposits most often occur as an oxide build-up on the surface or surfaces of the metal. Corrosion deposits can also be due, however, to the build-up of sulfides or the like on metal surfaces. While the process of the present invention is particularly effective in removing oxides and sulfides, it is applicable for the removal of corrosion deposits generally and is applicable to metals generally.

To effectively remove corrosion deposits from metal surfaces, the ferromagnetic fluid is generally at a temperature in the range of about 25° C. to about 100° C. Since the compositions freeze below about 0° C. and may decompose at temperatures above about 200° C., the temperature of the reaction can be in the range of from about 0° C. to about 200° C. However, the preferred temperature of the reaction is in the range of about 40° C. to about 80° C.

The concentrations of the ferromagnetic fluids which are effective for corrosion deposit removal can vary depending upon the composition of the particular ferromagnetic fluid used. Generally, concentrations in the range of from about 6 to about 30 weight percent solids are effective in the removal of corrosion deposits from metal surfaces. For the material of Example IV of U.S. Pat. No. 4,019,995, the most desirable visual appearance of the metal surface is obtained at a concentration of about 15 weight percent solids.

Corrosion deposits on metal surfaces can be removed using the described ferromagnetic fluid over a wide pH range. The pH range is chosen to provide acceptable corrosion deposit removal rates concomitant with minimum corrosion of the base metal. This range may vary depending on the particular metal surface being cleaned. As demonstrated in the Examples, when removing corrosion deposits from iron and mild steel the preferred pH of the reaction is in the range of from about 5 to about 9, with pH about 7 being optimum. Oxide removal from iron and mild steel is very slow when the ferromagnetic fluid is above about pH 9, and at pH values below about 5 the ferromagnetic fluid becomes slightly corrosive to the base metal. The corrosivity of the fluid to iron and mild steel is minimal above about pH 5 and it remains an effective corrosion deposit removal agent. Also, at lower pH values a black deposit tends to form on the base metal similar to pickling smut which forms when cleaning ferrous metals with sulfuric acid. The addition of sugars to the ferromagnetic fluid tends to reduce the amount of black deposit on the base metal.

To remove corrosion deposits from metal surfaces, the metal surface to be treated can be immersed in the ferromagnetic fluid for a period of time sufficient for corrosion deposit removal with or without agitation of the ferromagnetic fluid, or the ferromagnetic fluid may be applied to the metal surface and removed after a given period of time. The time of reaction, which may vary from hours to days, is dependent upon the type of base metal, the severity of the corrosion, the temperature of reaction, and the pH of the ferromagnetic fluid. The choice of appropriate conditions and time is within the skill of the routineer.

When compared with other formulations of lignosulfonates and with non-aqueous ferromagnetic fluids, it is shown that the ferromagnetic fluids described herein perform better as corrosion deposit removal agents. While the present invention is not to be considered to be based on any particular theory of reaction mechanism, such reaction mechanism not being completely understood, it is believed that the iron oxide component is a key ingredient in the efficiency of the ferromagnetic fluid as a corrosion deposit remover. The amount of iron desirably present in the fluid based on ferromagnetic fluid solids is within the skill of the art. Generally, ferromagnetic fluids will contain at least 5% by weight of iron based on ferromagnetic fluid solids.

The ferromagnetic fluids of this invention have been compared with other common corrosion deposit removal agents, and perform similarly to ammonium citrate and EDTA. An increase in the rate of corrosion deposit removal may be obtained when the ferromagnetic fluid is combined with other corrosion deposit removal agents. For example, solutions at a concentration of about 15 weight percent ferromagnetic fluid solids and about 15 weight percent ammonium citrate, at about pH 7, and at temperatures in the range of about 25° C. to about 95° C., are very effective in the removal or corrosion deposits. However, this may cause increased dissolution of the base metal relative to either component when used alone.

The experiments of the Examples herein were made on mild steel and aluminum. However, other metals, such as brass, chrome, copper, zinc and iron have also been tested qualitatiively, and the ferromagnetic fluid was effective at removing corrosion deposits from these metals as well.

The following Examples further illustrate the invention. These examples are included for illustrative purposes only and are not intended to limit the scope of the invention.

EXAMPLE I

Corroded mild steel coupons were cleaned with water and with mild abrasion to remove loose oxides and/or dirt and then dried at 65° C. for 15 minutes. The coupons were weighed and then placed in an 8-ounce tall-form jar containing the ferromagnetic fluid as described in Example IV of U.S. Pat. No. 4,019,995 which had previously been diluted with distilled water to a concentration of 15% total solids and adjusted to a pH of 7 with sulfuric acid. The solution containing the coupons was rolled for a specified period of time.

Periodically, the coupons were removed and washed, dried and re-weighed. A visual examination of the coupons was made and their appearance rated using the scale presented in Table I.

TABLE I

| Rating | Description |
|---|---|
| 1 | Shiny coupon, no corrosion deposits |

TABLE I-continued

| Rating | Description |
|---|---|
| 2 | Shiny finish predominant, some black deposits |
| 3 | Finish slightly more silver than black |
| 4 | Finish slightly more black than silver |
| 5 | Black finish predominant, some base metal exposed |
| 6 | All black finish, no base metal exposed |
| 7 | Severely corroded coupon, little or no rust removed |

The variable of temperature was tested under the described conditions for six days. One test was at ambient temperature, the second held at 65° C., and a third held at 95° C. While visual inspection of the coupons indicated effective corrosion deposit removal at both ambient temperature and 65° C., total weight loss was greater at 65° C.

The results of this experiment can be seen in Table II below.

TABLE II

| Temperature, C.° | Weight Loss, g. 1 Day | 2 Days | 6 Days | Appearance Ratings After 6 Days |
|---|---|---|---|---|
| ambient | 0.2045 | 0.3872 | 0.6988 | 3 |
| 65 | 0.4676 | 0.6993 | 0.9619 | 3 |
| 95 | 0.7701 | 0.8085 | 0.8734 | 5 |

In terms of visual appearance, the reaction at 95° C. was more effective in short-term experiments, as shown in Table III below.

TABLE III

| Temp. | Weight Loss, g. (6 hours) | Rating (6 hrs.) | Weight Loss, g. (1 day) | Rating (1 day) |
|---|---|---|---|---|
| 65° C. | 0.0564 | 5 | 0.1822 | 5 |
| 95° C. | 0.1443 | 5 | 0.4133 | 3 |

With extended periods of reaction time, a black deposit similar in appearance to the one mentioned above tended to form on the coupon.

EXAMPLE II

The variable of concentration of the ferromagnetic fluid was tested using the experimental procedures of Example I. The ferromagnetic fluid was adjusted to pH 7 with sulfuric acid and then diluted with distilled water to various concentrations. The reactions were tested at ambient temperature and at 65° C.

The coupons were removed from the solution, washed, dried and re-weighed at one-day intervals over a period of three days. The greatest weight loss occurred at 65° C. and a concentration of 10% total solids. However, a black deposit was left on the coupons under these conditions. The visual appearance obtained at 65° C. and a concentration of 15% total solids was preferable.

The results of this experiment are shown in Table IV below. The numbers in parentheses indicate the rating of the visual appearance of the coupons according to Table I.

TABLE IV

| % Total Solids | Temp., C.° | Weight Loss, g. 1 Day | 2 Days | 3 Days |
|---|---|---|---|---|
| 1 | ambient | *(7) | *(7) | *(7) |
| 10 | ambient | 0.0152(6–7) | 0.1428(6) | 0.2398(5) |
| 30 | ambient | 0.0087(6–7) | 0.0667(6–7) | 0.1756(6–7) |
| 10 | 65 | 0.7547(5) | 1.0715(5) | 1.3154(3) |
| 15 | 65 | 0.5113(4) | 0.8106(2) | 0.9359(1) |

TABLE IV-continued

| % Total Solids | Temp., C.° | Weight Loss, g. 1 Day | 2 Days | 3 Days |
|---|---|---|---|---|
| 30 | 65 | 0.2690(6) | 0.4495(5) | 0.5545(4) |

*Coupons not weighed

EXAMPLE III

The effect of the pH of the ferromagnetic fluid solution on corrosion deposit removal was tested using experimental procedures similar to those described in Example I. The pH of the solution was adjusted with sulfuric acid or sodium hydroxide. The temperature of the reaction was 65° C.

The coupons were examined at one-day intervals for a period of three days. The most effective corrosion deposit removal, in terms of weight loss and visual appearance, was obtained when the solution was adjusted with sulfuric acid to a pH in the range of 5 to 7.

The results of this experiment are shown in Table V below. The numbers in parentheses indicate the visual appearance rating according to Table I.

TABLE V

| pH | Acid/ Base | Weight Loss, g. 1 Day | 2 Days | 3 Days |
|---|---|---|---|---|
| 3 | $H_2SO_4$ | 0.7927(6) | 1.3096(3) | 1.5633(6) |
| 5 | $H_2SO_4$ | 0.3397(5) | 0.6141(4) | 0.7678(2) |
| 7 | $H_2SO_4$ | 0.3965(4) | 0.7492(2) | 0.8693(2) |
| 9 | NaOH | 0.2433(7) | 0.5010(7) | 0.6360(7) |
| 11 | NaOH | 0.0818(7) | 0.1329(7) | 0.1775(7) |

EXAMPLE IV

Under experimental conditions similar to those described in Example I, the ferromagnetic fluid was compared with another ferromagnetic lignosulfonate which contained less iron on a solids basis, and to various other non-ferromagnetic iron lignosulfonate compositions. The lignosulfonate solutions were prepared at identical concentrations of total solids. The iron contents were calculated on an oven-dry solids basis. The ferromagnetic fluid out-performed the other lignosulfonates as a corrosion deposit removal agent in terms of both weight loss and visual appearance. As these data show, ferromagnetic fluids containing higher iron contents tend to be more effective. Moreover, it can be seen that the ferromagnetic fluids are supenux to compounds containing only chelated iron or iron salts (compounds which are not ferromagnetic fluids).

The results of this comparison are shown in Table VI below. The numbers in parentheses represent the appearance rating according to Table I.

TABLE VI

| Lignosulfonate % Solution | Oven Dry Fe | Weight Loss, g. 1 Day | 2 Days | 3 Days |
|---|---|---|---|---|
| Ferromagnetic fluid | 32 | 0.5113(4) | 0.8106(2) | 0.9359(1) |
| Ferromagnetic fluid | 15 | 0.3347(5) | 0.5579(5) | 0.7020(4) |
| Iron chelate of lignosulfonic acid | 12 | 0.2485(6) | 0.4177(6) | 0.5118(6) |
| Iron salt of a purified lignosulfonate | 8.6 | 0.3342(5) | 0.5059(5) | 0.6586(5) |
| Iron salt of fermented spent sulfite liquor | 18 | 0.4355(5) | 0.6982(5) | 0.8648(5) |

In a comparison of the ferromagnetic fluid with other ferromagnetic fluid formulations, coupons were evaluated after one day, two days, three days and, in some cases, six days in the various solutions. The results of the comparison are shown in Table VII.

TABLE VII

| Sample Composition Description | Weight % Fe | Weight % Total Solids | Weight Loss, g. 1 Day | 2 Days | 3 Days | 6 Days |
|---|---|---|---|---|---|---|
| Ferromagnetic fluid[1] | 4.8 | 15 | 0.5145 | 0.7519 | 0.8968 | — |
| $Fe_3O_4 + H_2O$ | 4.8 | | 0.2527 | 0.3320 | 0.4039 | — |
| $Fe_3O_4 + NaLS^2 + H_2O$ | 4.8 | | 0.3577 | 0.5204 | 0.6854 | — |
| Ferromagnetic fluid[1] | 4.8 | 15 | 0.5555 | — | — | 0.9016 |
| Kerosene-base ferromagnetic fluid[3] | 4.8 | | 0.1797 | — | — | 0.3154 |
| Kerosene-base ferromagnetic fluid[4] | 3.2 | | — | no loss | no loss | — |
| Ferromagnetic fluid[1] | 4.8 | 15 | 0.1094 | 0.1492 | — | — |
| Aqueous-base ferromagnetic fluid[5] | 4.8 | | 0.1286 | 0.1405 | — | — |
| Ester-base ferromagnetic fluid[6] | 4.8 | | no loss | no loss | — | — |

[1]Ferromagnetic fluid as described in U. S. Pat. No. 4,019,995
[2]Sodium salt of a purified lignosulfonate at sufficient concentration to approximate the lignin-type material of sample 1 above
[3]Sample prepared according to Bureau of Mines Technical Progress Report 59, "Preparing Magnetic Fluids by a Peptizing Method," September, 1972 (G. W. Reimers and S. E. Khalafalla)
[4]Sample provided by the Bureau of Mines, diluted to 3.2% Fe with kerosene
[5]Commercial product available from Ferrofluidics Corporation
[6]Commercial product available from Ferrofluidics Corporation; this sample was diluted to 4.8% Fe with propylene carbonate

EXAMPLE V

The general procedure of Example I was repeated except that clean, non-corroded mild steel coupon weighing 35.7682 gms. was employed. The temperature of the test was 65° C. After 20 hours the coupon lost only 0.0364 g. (0.10%) and after 44 hours the coupon lost only 0.0671 gms. (0.19%). These data demonstrate that the ferromagnetic fluid is substantially non-corrosive to the base metal.

EXAMPLE VI

Three sets of experiments were run to compare the quantity of corrosion deposits which can be removed by the ferromagnetic fluid of Example I with the quantity removed by various other common corrosion deposit removal agents. At the end of the first and second sets, the coupons were removed from the solutions and new corroded coupons added. All solutions were tested at 15% solids, except the phosphoric acid sample, and the pH of each sample was adjusted to pH 7, except when noted. The pH was not re-adjusted between sets. The temperature of reaction was 65° C. Phosphoric acid was tested only in the first set of experiments as the coupons dissolved after reaction for 164 hours.

The weight loss of the coupons is reported for each set of experiments in Table VIII below, along with the total weight loss of the three sets. As shown in the Table, the ferromagnetic fluid, ammonium citrate and EDTA at pH 7, all removed comparable amounts of corrosion deposits from the first coupons, but the ferromagnetic fluid was more effective overall as a corrosion deposit removal agent, as demonstrated by its continued effectiveness with additional coupons. Without further treatment of the supernatant liquor, the ferromagnetic fluid has more capacity per unit weight as a corrosion deposit removal agent.

TABLE VIII

| | Weight Loss, g. | | | |
|---|---|---|---|---|
| Sample | Set 1 (164 hr.) | Set 2 (64 hr.) | Set 3 (67 hr.) | Total |
| Ferromagnetic fluid | 1.2913 | 1.0729 | 0.6586 | 3.0228 |
| Ammonium citrate | 1.5889 | 0.5022 | 0.1350 | 2.2261 |
| Sodium gluconate | 0.5450 | 0.7236 | 0.1534 | 1.4220 |
| Sodium gluconate (+5% NaOH by weight) | 0.8694 | 0.3938 | 0.2480 | 1.5112 |
| Ethylenediaminetetra-acetic acid, disodium salt | 1.3557 | 1.2366 | 0.3210 | 2.9133 |
| Ethylenediaminetetra-acetic acid, disodium salt (+5% NaOH by weight) | 0.1367 | 0.2381 | 0.1749 | 0.5497 |
| Phosphoric acid | | coupon dissolved | | |

EXAMPLE VII

An experiment was made with the ferromagnetic fluid of Example I in combination with various other corrosion deposit removal agents. Solutions of 15 weight percent ferromagnetic fluid with 15 weight percent ammonium citrate, 15 weight percent sodium gluconate, and 15 weight percent EDTA were tested at pH 7, except where noted, and at 65° C. The coupons were evaluated after reaction in the solutions for one day, two days and four days. The addition of the ferromagnetic fluid to these other agents improved their performance at removing corrosion deposits. However, the ferromagnetic fluid added to sodium gluconate improved its performance only after the first day. The results of this comparison are presented in Table IXbelow.

TABLE IX

| | Weight Loss, g. | | |
|---|---|---|---|
| Sample | 1 Day | 2 Days | 4 Days |
| Ferromagnetic fluid + ammonium citrate | 1.8038 (1.34) | 2.1485 (1.45) | 2.3809 |
| Ferromagnetic fluid + sodium gluconate | 0.4496 (.33) | 0.9657 (.42) | 1.2697 |
| Ferromagnetid fluid + sodium gluconate (+5% NaOH) | 0.4561 (.40) | 0.5468 (.48) | 0.6269 |
| Ferromagnetic fluid + ethylenediaminetetra-acetic acid, disodium salt | 0.8682 (1.04) | 1.3144 (1.16) | 1.4774 |
| Ferromagnetic fluids + ethylenediaminetetra-acetic acid, disodium salt | 0.3210 (.10) | 0.3617 (.12) | 0.4197 |

TABLE IX-continued

| | Weight Loss, g. | | |
|---|---|---|---|
| Sample | 1 Day | 2 Days | 4 Days |
| (+5% NaOH) | | | |

Numbers in parentheses indicate results for corrosion deposit removal agent without added ferromagnetic fluid.

EXAMPLE VIII

The ferromagnetic fluid of Example I (22.5 g. solids) was adjusted to pH 7 with 1 N $H_2SO_4$ in an 8-ounce tall-form jar and diluted to 150 g. with distilled water. A severely corroded aluminum rod was cleaned with water and mild abrasion to remove loose oxides and/or dirt and dried at 65° C. for 15 minutes. The rod was weighed (107.8703 g.) and placed in the ferromagnetic solution. The solution plus the rod were mildly agitated at 65° C. After 24 hours, the rod was removed, washed with distilled water, dried at 65° C. and weighed (107.7824 g.). The rod was then placed back into the ferromagnetic solution and mildly agitated for three more days. Again, the rod was removed, washed, dried and weighed (107.5942 g.). After four days the weight loss of the aluminum rod was 0.2761 g. and it was free of corrosion deposits.

Since modifications of this invention will be apparent to those skilled in the art, it is intended that this invention be limited only by the scope of the appended claims.

What is claimed :

1. A process for the removal of corrosion deposits from corroded metal surfaces which comprises contacting said corroded metal surfaces with an aqueous-base ferromagnetic fluid in an amount effective to remove corrosion deposits and thereafter removing said aqueous-base ferromagnetic material and corrosion deposits from said metal surface.

2. A process according to claim 1 wherein said corroded metal surface is immersed in said ferromagnetic fluid for the removal of said corrosion deposits for a period of time sufficient to remove or loosen said corrosion deposits.

3. A process according to claim 1 wherein said corrosion deposits are removed by contacting said corroded metal surface with said ferromagnetic fluid and the fluid agitated for a period of time sufficient to loosen or remove said corrosion deposits.

4. A process according to claim 1 wherein said ferromagnetic fluid is applied to said corroded metal surface for a period of time sufficient to remove or loosen said corrosion deposits and thereafter removing said ferromagnetic fluid and corrosion deposits from said metal surface.

5. A process according to claims 1, 2, 3 or 4 wherein said aqueous-base ferromagnetic fluid contains sulfonate lignin or sulfonated tannin combined with iron in the form of an iron oxide.

6. A process according to claim 1 wherein said aqueous-base ferromagnetic fluid is obtained by reaction of soluble iron salts with sulfonated phenol-formaldehyde polymer.

7. A process according to claim 1 wherein said aqueous-base ferromagnetic fluid is obtained by a grinding process.

8. A process according to claim 1 wherein said metal surface is iron.

9. A process according to claim 1 wherein said metal surface is mild steel.

10. A process according to claim 1 wherein said metal surface is selected from the group consisting of aluminum, brass and copper.

11. A process according to claim 1 wherein said metal surface is selected from the group consisting of chromium and zinc.

12. A process according to claim 1 wherein the temperature of the contacting step is in the range of from about 25° C. to about 100° C.

13. A process according to claim 1 wherein the concentration of said aqueous-base ferromagnetic fluid is from about 6 weight percent to about 30 weight percent.

14. A process according to claim 8 or 9 wherein the pH of the ferromagnetic fluid is in the range of from about 5 to about 8.

* * * * *